US011772376B2

(12) United States Patent
Hogan et al.

(10) Patent No.: US 11,772,376 B2
(45) Date of Patent: Oct. 3, 2023

(54) SUB-ROW FIRING METHOD FOR SINGLE-PASS MONOCHROME PRINTING AT HIGH SPEEDS

(71) Applicant: Memjet Technology Limited, Dublin (IE)

(72) Inventors: Julie Catherine Hogan, Dublin (IE); Ronan Palliser, Dublin (IE); John Sheahan, North Ryde (AU); Brian Brown, North Ryde (AU); Caitriona Forbes, Dublin (IE); Pat Lehane, Dublin (IE)

(73) Assignee: Memjet Technology Limited, Dublin (IE)

( * ) Notice: Subject to any disclaimer, the term of this patent is extended or adjusted under 35 U.S.C. 154(b) by 74 days.

(21) Appl. No.: 17/467,909

(22) Filed: Sep. 7, 2021

(65) Prior Publication Data

US 2022/0072850 A1 Mar. 10, 2022

Related U.S. Application Data

(60) Provisional application No. 63/076,043, filed on Sep. 9, 2020.

(51) Int. Cl.
*B41J 2/045* (2006.01)

(52) U.S. Cl.
CPC ..... *B41J 2/04505* (2013.01); *B41J 2/04541* (2013.01); *B41J 2/04573* (2013.01); *B41J 2/04586* (2013.01)

(58) Field of Classification Search
CPC .. B41J 2/04505; B41J 2/0456; B41J 2/04586; B41J 2/04501; B41J 13/12; B41J 11/0065; B41J 2/01; B41J 29/12; B41J 11/06
See application file for complete search history.

(56) References Cited

U.S. PATENT DOCUMENTS

| | | | | |
|---|---|---|---|---|
| 2006/0125857 | A1 | 6/2006 | Silverbrook | |
| 2010/0045716 | A1 | 2/2010 | Sugahara | |
| 2017/0282545 | A1* | 10/2017 | Muto | B41J 2/04568 |

(Continued)

FOREIGN PATENT DOCUMENTS

| | | | |
|---|---|---|---|
| EP | 0938976 | A1 | 9/1999 |
| EP | 1826005 | A1 | 8/2007 |
| WO | WO 2022053257 | A1 | 3/2022 |

OTHER PUBLICATIONS

European Patent Office, International Search Report and Written Opinion for PCT/EP2021/072548, dated Dec. 6, 2021, 19 pages.

*Primary Examiner* — Kristal Feggins
(74) *Attorney, Agent, or Firm* — Cooley LLP

(57) ABSTRACT

A method of printing an image from a printhead module having a plurality of horizontal ink planes M supplied with a same ink. Each ink plane has a nozzle row and the nozzles rows of all ink planes have vertically aligned nozzles. The method includes the steps of: defining contiguous span groups along each nozzle row, each span group containing N nozzles; allocating dot data for each image line of the image to a predetermined number of nozzles P in each span group of each nozzle row; sending the dot data to the printhead module and firing nozzles sequentially from the ink planes to print the image line. Only one nozzle from each span group in a same nozzle row is fired simultaneously, N is an integer multiple of M, and P is N divided by M.

13 Claims, 3 Drawing Sheets

(56) References Cited

U.S. PATENT DOCUMENTS

| | | | | |
|---|---|---|---|---|
| 2021/0060951 | A1* | 3/2021 | Inoue | B41J 2/2103 |
| 2022/0072850 | A1 | 3/2022 | Hogan | |
| 2022/0072852 | A1 | 3/2022 | Hogan | |

* cited by examiner

9

SUB-ROW FIRING METHOD FOR SINGLE-PASS MONOCHROME PRINTING AT HIGH SPEEDS

CROSS REFERENCE TO RELATED APPLICATIONS

This application claims priority to and the benefit of U.S. Provisional Patent Application No. 63/076,043, entitled METHOD AND PRINT CHIP FOR SINGLE-PASS MONOCHROME PRINTING AT HIGH SPEEDS, filed on Sep. 9, 2020, the disclosure of which is incorporated herein by reference in its entirety for all purposes.

FIELD OF THE INVENTION

This invention relates to methods for single-pass printing using multiple butting print chips, as well as print chips designed for such printing. It has been developed primarily for enabling a wide range of print modes in very high speed monochrome printheads having multiple nozzle rows.

BACKGROUND OF THE INVENTION

Inkjet printers employing Memjet® technology are commercially available for a number of different printing formats and markets. For example, certain color printing technologies, such as label printers described in U.S. Pat. No. 8,562,104 and wideformat printers described in U.S. Pat. No. 8,480,221, employ color printheads configured for printing CMYK inks from a single printhead. Such color printheads have multiple print chips attached to a manifold distributing multiple ink colors to each print chip, as described in U.S. Pat. No. 7,475,976. More recently, monochrome printheads have been developed using Memjet® technology, particularly to meet the demands of high-speed digital presses, such as those described in U.S. Pat. No. 10,081,204, in which multiple monochrome printheads are aligned along a media feed path. Such monochrome printheads have multiple print chips attached a manifold delivering a single ink color to each print chip, as described in U.S. Pat. No. 9,950,527.

Both the color printheads and monochrome printheads described above ubiquitously employ a Memjet® print chip 1 (FIG. 1) that is specially designed to enable multiple print chips to be butted together in a line along the printhead. Each nozzle row 3 of the Memjet® print chip 1 shown in FIG. 1 uniquely has a dropped row portion 7 at one end of the print chip, which is vertically offset from a corresponding main row portion 5 containing the majority of nozzles for that nozzle row. Typically, the vertically offset dropped row portions 7 are arranged in a trapezoidal or generally triangular shape (known in the art as a "dropped nozzle region", "displaced nozzle region" or "dropped triangle region") and enable print chips to be butted together whilst effectively maintaining a constant dot pitch across the join region. An A4 pagewide printhead 9 comprised of eleven butting Memjet print chips 1 mounted on a substrate 10 is shown schematically in FIG. 3. Similarly, an A3 printhead may be constructed using 16 butting print chips.

The nozzles in a given dropped nozzle portion 7 of a nozzle row 3 are hardwired to fire their nozzles at the same as the nozzles in the corresponding main row portion 5 of that nozzle row. Since there is fixed vertical separation along the media feed direction between nozzles in the dropped nozzle region 11 and the main nozzle region 13, the data sent to the nozzles in the dropped nozzle region is delayed by a predetermined number of lines so that droplets fired from nozzles in the dropped nozzle region can join seamlessly with droplets fired from the main nozzle region to form a single line of print. Typically, there is a fixed separation of 10 dot pitches ("DP") in the media feed direction between each dropped nozzle portion and its corresponding main nozzle portion, when printing at 1600×1600 dpi (i.e. 1 DP=$1/1600$ inch) at a maximum dot-on-dot printing speed (nominally 12 inches per second). Therefore, by delaying the data sent to each dropped nozzle portion by 10 lines of print, seamless printing across the join region can be achieved when printing at 1600 dpi in the media feed direction. A more detailed description of Memjet® print chips having dropped nozzle rows can be found in U.S. Pat. No. 7,290,852, the contents of which are incorporated herein by reference.

In principle, employing all nozzle rows in one print chip for printing one ink color should allow printing at higher print speeds for monochrome printing. However, if one wishes to print at a different print resolution and/or a faster print speed a problem arises in respect of the dropped nozzle compensation method described above. Firstly, the maximum firing frequency of each nozzle is fixed due to the time it takes for each firing chamber to be refilled with ink after droplet ejection. Consequently, the period for one fire cycle (i.e. the time allocated for all nozzles in one print chip to fire) is necessarily limited by the maximum firing frequency. Thus, inkjet nozzles cannot simply be actuated more frequently in order to print at faster speeds—usually inkjet nozzles already operate at (or close to) their maximum firing frequency. Typically, Memjet® inkjet nozzles have a maximum firing frequency of about 15 kHz.

Secondly, the printed dot pitch must change when printing at a lower print resolution and/or higher speed while the physical separation between the dropped nozzle region and the main nozzle region remains fixed at a nominal $10/1600^{th}$ of an inch in the case of a Memjet® printhead.

If, for example, one wished to print at 5× speed (nominally 60 inches per second) with a vertical print resolution of 1600 dpi, each nozzle row in the dropped nozzle region is offset by 10 print lines ($10/1600^{th}$ inch÷$1/1600$=10) below its corresponding main nozzle row. Since 10 lines corresponds to 2 fire cycles at 5× printing speed, the nozzles in the dropped nozzle region 11 can seamlessly print dots to join with a line of dots printed by nozzles in the main nozzle region 13. Nozzles in the each main row portion 5 and corresponding dropped row portion 7 of the same nozzle row 3 always fire at the same time (or, more accurately, within the same row-time), but the dropped row portion is loaded with dot data from two lines after the dot data loaded into the main row portion. Similarly, with a vertical print resolution of 800 dpi the nozzles in the dropped nozzle region 11 can join seamlessly with nozzles from the main nozzle region 13, because the dropped nozzle region is offset by 5 print lines ($10/1600^{th}$ inch÷$1/800$=5), which corresponds to 1 fire cycle at 5× print speed.

On the other hand, if one wished to print at 5× speed with a vertical print resolution of 400 dpi, perfect compensation by nozzles in the dropped nozzle region 11 is not possible. Now the dropped row portions 7 are offset by 2.5 print lines ($10/1600^{th}$ inch÷$1/400$=2.5) from their corresponding main row portions 5. Since 2.5 print lines does not coincide with a whole fire cycle at 5× speed, print artefacts inevitably occur at the transition between the main nozzle region 13 and the dropped nozzle region 11, because dropped row portions cannot print droplets to align with droplets printed from corresponding main row portions. A similar error occurs when printing at 5× speed with a vertical print resolution of 1200 dpi, because the dropped row portions are offset by 7.5 print lines ($^{10}/_{1600}{}^{th}$ inch÷$^{1}/_{1200}$=7.5) from their corresponding main row portions.

FIG. 4 shows the variations in error due to the fixed offset of the dropped nozzle region relative to the main nozzle region for various printing resolutions at 5× speed (monochrome) using the method described above. As explained above, minimal errors are achieved with resolutions of 1600 dpi and 800 dpi, while maximal errors occur when printing at 1200 dpi and 400 dpi. With 1 dot pitch nominally deemed to be an acceptable amount of error, it can be seen from FIG. 4 that there are a number of print modes where acceptable print quality is unachievable. In practice, tolerance for certain artefacts may be different for different types of image content e.g. contone images, line images, text etc.

From the foregoing, it will be understood that a relatively limited number of print modes are achievable when printing in monochrome at high speeds using the dropped nozzle compensation methods described in U.S. Pat. No. 7,290,852. Notwithstanding this limitation, the fundamental design of the print chip described in U.S. Pat. No. 7,290,852, incorporating the dropped nozzle region, remains a very attractive means for designing pagewide printheads for high-speed printing. The dropped nozzle region enables print chips to be butted together in a row, which narrows the print zone and avoids positioning chips in a relatively wider staggered array. Narrowing the print zone advantageously places fewer demands on media feed mechanisms and generally achieves higher print quality than other pagewide systems having relatively wider print zones.

It would therefore be desirable to provide a means by which print chips incorporating dropped nozzles rows can be used for high-speed monochrome printing in a wider range of print modes.

SUMMARY OF THE INVENTION

In a first aspect, there is provided a method of printing an image from a printhead module having a plurality of horizontal nozzle rows, each nozzle row having a main row portion and a corresponding dropped row portion vertically offset from the main row portion, the method comprising the steps of:

identifying a print speed;

identifying a print resolution;

determining a predetermined delay for the dropped row portions based on the offset, the print speed and the print resolution;

storing the predetermined delay in a register of the printhead module;

allocating dot data for image lines to respective nozzle rows based on the print speed and print resolution, wherein each main row portion and its corresponding dropped row portion are allocated dot data for a same image line;

sending the dot data to the printhead module, the dot data including first dot data for each main row portion and second dot data for each dropped row portion;

firing nozzles from the main row portions in a predetermined sequence based on the print speed and print resolution; and firing nozzles from the dropped row portions in said predetermined sequence, wherein each dropped row portion is fired independently of its corresponding main row portion and delayed relative to its corresponding main row portion by the predetermined delay stored in the register, such that the predetermined delay aligns droplets fired from each dropped row portion with droplets fired from its corresponding main row portion.

Preferably, the first dot data is transferred to first data latches corresponding to the main row portion and the second dot data is buffered in a dedicated buffer of the printhead module.

Preferably, the buffered second dot data is transferred to second data latches corresponding to the dropped row portion based on the predetermined delay.

Preferably, the first data latches are positioned in a row along one side of the main row portions and the second data latches are positioned in a row along an opposite side of the dropped row portions.

Preferably, the predetermined delay stored in the register is updated for different print jobs.

Preferably, the dropped row portions have different lengths.

Preferably, the dropped row portions together are arranged in a trapezoidal or a triangular shape.

Preferably, the printhead module comprises a plurality of ink planes, each ink plane containing one or more nozzle rows supplied with a same ink.

Preferably, the printhead module comprises a plurality of redundant ink planes.

Preferably, the printhead module is a monochrome printhead module having all nozzle rows supplied with a same ink.

Preferably, the dot data is sent row-wise to the printhead module and a same amount of dot data is sent for each nozzle row.

Preferably, the dot data comprises a '1' for an enabled firing nozzle and a '0' for a non-enabled non-firing nozzle.

In a second aspect, there is provided a print chip comprising:

an elongate silicon substrate defining nominal leading and trailing longitudinal sides of the print chip;

one or more circuitry layers positioned on the silicon substrate; and a MEMS layer positioned on the circuitry layers, said MEMS layer comprising a plurality of parallel nozzle rows, each nozzle row comprising a plurality of inkjet nozzle devices arranged in a main row portion and a dropped row portion offset from the main row portion, wherein:

the circuitry layers comprise data latches configured to provide dot data for the inkjet nozzle devices;

a first row of data latches is positioned adjacent a leading row of the main row portion; and a second row of data latches is positioned adjacent a trailing row of the dropped row portion.

Preferably, a first set of conductive traces extend from the first row of data latches towards the main row portion; and a second set of conductive traces extend from the second row of data latches towards the dropped row portion in an opposite direction to the first set of conductive traces.

Preferably, the dropped row portions together are arranged in a trapezoidal shape.

Preferably, the trapezoidal shape has a leading nozzle row and a parallel trailing nozzle row, the trailing nozzle row being relatively longer than the leading nozzle row.

Preferably, the first and second sets of conductive traces are parallel to each other.

Preferably, in use, the leading side of the print chip is upstream relative to a media feed direction.

Preferably, in use, the trailing side of the print chip is downstream relative to a media feed direction.

Preferably, the circuitry layers further comprise a command unit for receiving rows of dot data for the print chip.

Preferably, the command unit is positioned adjacent a trailing nozzle of the main row portion.

Preferably, the command unit is configured for dividing each row of dot data into first dot data and second data.

Preferably, the circuitry layers further comprise a buffer, and the command unit is configured to route first dot data directly to the first row of data latches and route second dot data to the second row of data latches via the buffer.

Preferably, the buffer is configured to buffer the second dot data for a predetermined delay period before the dot data is sent to the second row of data latches.

Preferably, the command unit comprises a configurable register for storing a value of the predetermined delay period.

Preferably, the buffer has a data capacity corresponding to a number of nozzles in the dropped nozzle portion.

Preferably, the print chip further comprises a row of electrical pads positioned along one side of the print chip, and wherein the command unit is configured to receive the rows of dot data via the electrical pads.

Preferably, the electrical pads are positioned along the trailing side of the substrate.

Preferably, each nozzle row in the dropped row portion is configured to fire its inkjet nozzles independently of a corresponding nozzle row in the main row portion.

In a third aspect, there is provided a method of printing an image from a printhead module having a plurality of horizontal ink planes M supplied with a same ink, each ink plane having at least one nozzle row, the nozzles rows of all ink planes having vertically aligned nozzles, the method comprising the steps of:

defining contiguous span groups along each nozzle row, each span group containing N nozzles;

allocating dot data for each image line of the image to a predetermined number of nozzles P in each span group of each nozzle row;

sending the dot data to the printhead module and firing nozzles, based on the dot data, sequentially from each of the M ink planes to print the image line of the image such that all ink planes contribute dots to the printed image line, wherein:

only one nozzle from each span group in a same nozzle row is fired simultaneously;

N is an integer multiple of M; and

P is N divided by M.

Preferably, each ink plane comprises a pair of nozzle rows.

Preferably, the pair of nozzle rows are offset for printing even and odd dots.

Preferably, the method is repeated for printing all image lines of the image.

Preferably, span groups of different nozzle rows having different firing nozzles.

Preferably, the firing nozzles in the span groups of consecutively fired nozzle rows are horizontally shifted by S nozzles. Preferably, S is 1.

Preferably, 1/Mth of the image line is printable by each ink plane.

Preferably, the dot data comprises a '1' for an enabled firing nozzle and a '0' for a non-enabled non-firing nozzle.

Preferably, all aligned nozzle rows in the M ink planes are fired, based on the dot data, within one row-time, and wherein one row-time is less than or equal to a time period for firing all nozzles in the printhead module divided by the number of nozzle rows.

Preferably, one or more steps of the method are repeated to print all image lines of the image.

Preferably, the dot data is allocated to a given nozzle row based on a print speed and a position of print media during the sequential firing of nozzles from each of the M ink planes.

Preferably, corresponding span groups in different nozzle rows are vertically aligned.

As used herein, the term "ink" refers to any ejectable fluid and may include, for example, conventional CMYK inks (e.g. pigment and dye-based inks), infrared inks, UV-curable inks, fixatives, primers, binders, 3D printing fluids, polymers, sensing inks, biological fluids etc.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
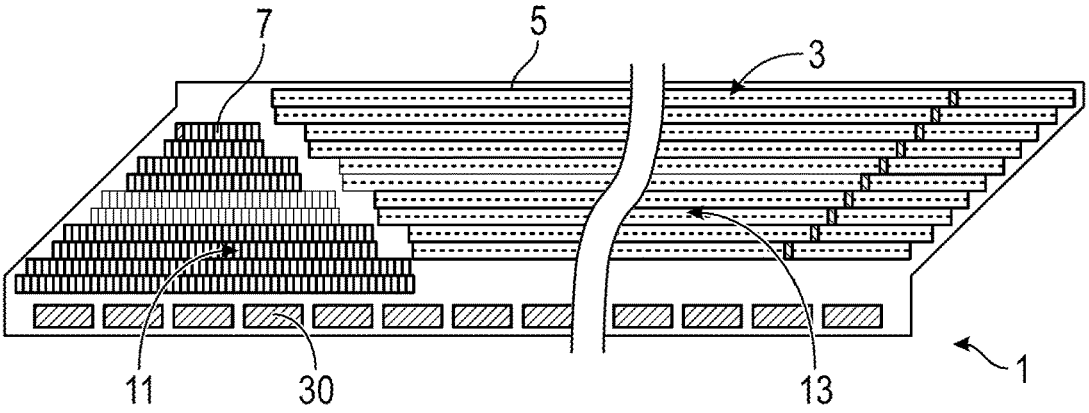
FIG. 1 shows a print chip having a dropped nozzle region.

Referring to FIG. 1, the printing methods described herein employ printhead modules, typically in the form of print chips as described in, for example, U.S. Pat. No. 7,290,852. Accordingly, each print chip comprises horizontal rows of nozzles extending parallel with a longitudinal axis of the print chip. Each nozzle row has a main row portion and a corresponding displaced ("dropped") row portion, which is vertically offset from its main row portion.

Figure 2:
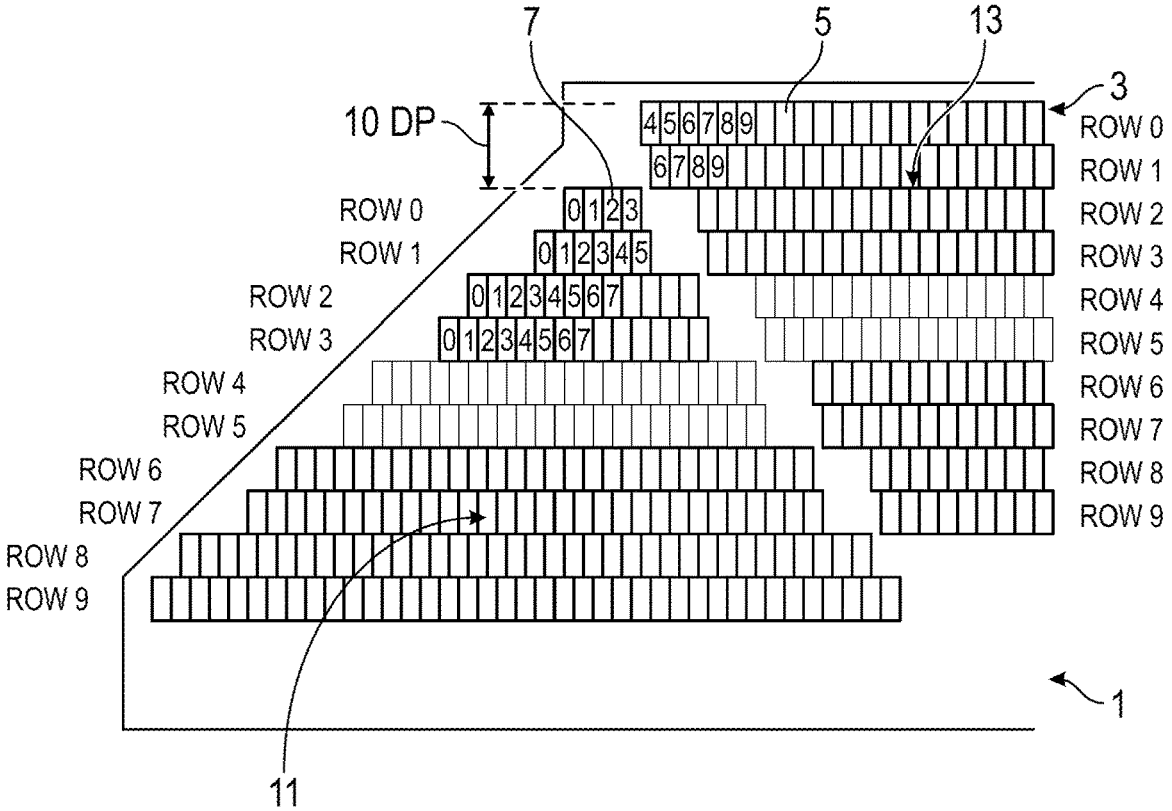
FIG. 2 is a magnified view of the dropped nozzle region.
Figure 3:
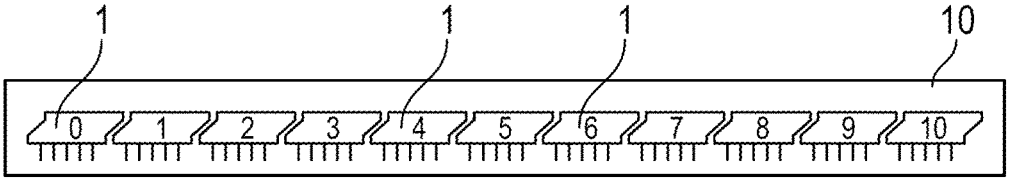
FIG. 3 is a schematic view of a printhead having multiple butting print chips.

For the sake of convenience, the print chip is defined to have a nominal horizontal axis extending parallel with its length dimension and a nominal vertical axis extending perpendicular to the horizontal axis. As used herein, the terms "horizontal" and "vertical" are not intended to limit the orientation of print chips or nozzles rows in use. Furthermore, the term "dropped" (e.g. "dropped row portion", "dropped nozzle region" etc) is not intended to limit the orientation of the print chip relative to a media feed direction—a "dropped row portion" merely means that a row portion is displaced, either upstream or downstream relative to a media feed direction, of a corresponding main row portion Nozzles in the main row portion extend along a majority of the length of the print chip, while nozzles in the dropped row portion are positioned at one end of the print chip. The total number of nozzles in each main row portion and corresponding dropped row portion is the same for all nozzle rows (e.g. 640 nozzles per row). However, the dropped row portions each have different lengths and, as shown in FIGS. 1 and 2, are together arranged in a generally trapezoidal shape in plan view. The multiple dropped row portions having a trapezoidal shape are together referred to as a "dropped nozzle region" of the print chip.

The print chip shown in FIGS. 1 and 2 contains five ink planes, which are all supplied with a same color of ink for monochrome printing. Each ink plane contains two nozzle rows ("odd" and "even") horizontally offset from each other by 1 dot pitch. Since the nozzles within the same nozzle row are spaced apart by 2 dot pitches, then the odd and even nozzle rows in one ink plane can print odd and even dots in one line of print. In the embodiment shown, the odd and even nozzle rows within the same ink plane are vertically offset from each other by 4 dot pitches, while each dropped row portion is offset from its corresponding main row portion by 10 dot pitches (at a nominal 1600 dpi).

While one embodiment is described herein with reference to a Memjet print chip printing at a nominal 1600 (horizontal)×1600 (vertical) dpi, it will of course be appreciated that the present invention is not limited by way of print resolution or print speed.

Figure 4:
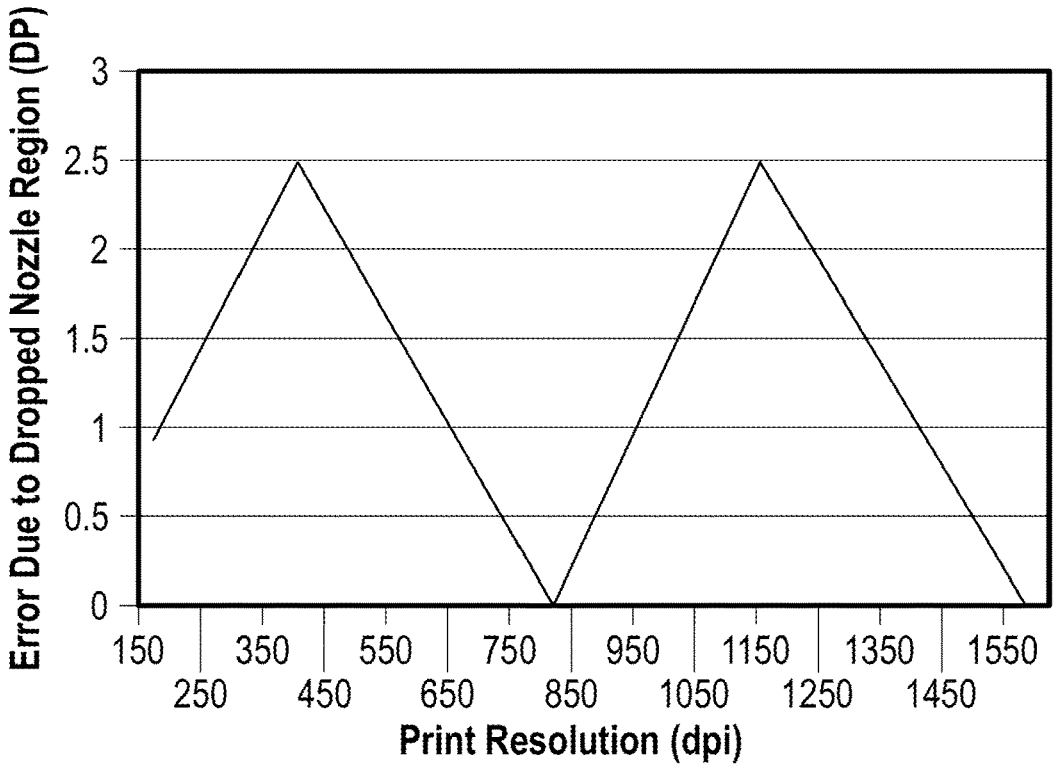
FIG. 4 shows dot placement errors resulting from dropped nozzle region artefacts in various print modes.

As best seen in FIG. 2, each dropped row portion is positioned to align horizontally with its corresponding main row portion such that a constant dot pitch is effectively maintained both along the print chip and between neighboring print chips. In this way, the dropped row portions can, in principle, compensate for printing in the join regions between neighboring print chips where nozzles cannot be fabricated due to a lack of available silicon at the edges of the print chips. Nevertheless, due to the problems foreshadowed above, the print chip described U.S. Pat. No. 7,290,852 is not ideally suited for fast printing (e.g. at a nominal 5× print speed) in monochrome for all printing resolutions. For example, as explained above and with reference to FIG. 4, when printing in monochrome at 1200 dpi and 5× print speed, errors of 2.5 DP occur between the main nozzle region and the dropped nozzle region. This error produces noticeable artefacts on the printed page.

Independent Firing of Dropped Nozzle Region

Typically, an inkjet printhead receives its dot data and fires its nozzles row-by-row to eject droplets. A given nozzle device of a row will fire if both a row enable signal and a column enable signal are set to 1 on receipt of a fire signal. In one fire cycle of the print chip, all nozzle rows receive a fire signal within a fire cycle time such that all enabled nozzle devices of the print chip are fired. For a given number of nozzle rows, the fire cycle time is limited by the maximum ejection frequency of each nozzle device—a physical limitation due to the maximum refill rate of each nozzle device.

Within each fire cycle, each nozzle row has an allocated row cycle time, which is the fire cycle time divided by the number of nozzle rows. For dot-on-dot printing (e.g. CMYKK printing), the fire cycle must be completed within one line-time—that is, the time taken for the media to advance by one line or one vertical dot pitch (nominally 1600 dpi for a Memjet® print chip). Memjet® print chip has five ink planes and ten nozzle rows (one pair of nozzle rows, even and odd, per ink plane). Each nozzle row is allocated $1/10^{th}$ of the line time to fire its nozzles at a predetermined print speed (nominally 12 inches per second). When printing in monochrome at 5× print speed (nominally 60 inches per second), the media necessarily advances by 5 lines (or 5 vertical dot pitches) during one fire cycle. In other words, only two rows of nozzles are able to print in the time taken for the media to advance by one dot pitch at a nominal 1600 dpi. This leads to droplet placement errors for certain print modes, such 400 dpi and 1200 dpi printing at 5× print speed.

In order to address the problems foreshadowed above when printing in monochrome at 5× printing speed, the print chip according to the present invention is configured to fire nozzles in the dropped nozzle region independently of nozzles in the main nozzle region. Decoupling the firing of nozzle rows in the dropped nozzle region from those in the corresponding main nozzle region enables droplets fired from the dropped nozzle region to align perfectly with droplets fired from the main nozzle region irrespective of the print speed and print resolution.

Hitherto, print chips known in the prior art fired nozzles on a row-by-row basis with all enabled nozzles in the same row firing within an allocated row-time. (In practice, all enabled nozzles in the same row are not fired simultaneously within their allocated row-time due to power constraints. As described in U.S. Pat. No. 7,780,256, the contents of which are incorporated herein by reference, the enabled nozzles are fired in span groups separated by a predetermined 'span' and firing is sequenced according to a predetermined 'shift' within each span group).

Therefore, independent firing of nozzles from the "same" nozzle row presents challenges both in terms of implementation and chip design. Simplistically, the print chip could be treated as having 20 nozzle rows—10 nozzle rows in the main nozzle region and 10 nozzle rows in the dropped row region. Dot data and fire signals could then be sent to the print chip in 20 separate data pulses in sequence. However, this type of implementation is problematic, because the data pulses would contain non-equal amounts of data. Those data pulses corresponding to the main nozzle region will contain much larger amounts of data than those data pulses corresponding to the dropped nozzle region. And even within the dropped nozzle region and main nozzle region, each nozzle row has a different number of nozzles requiring different amounts of data. However, data transfer should ideally be as smooth as possible with a same data allocation for each data pulse.

Figure 5:
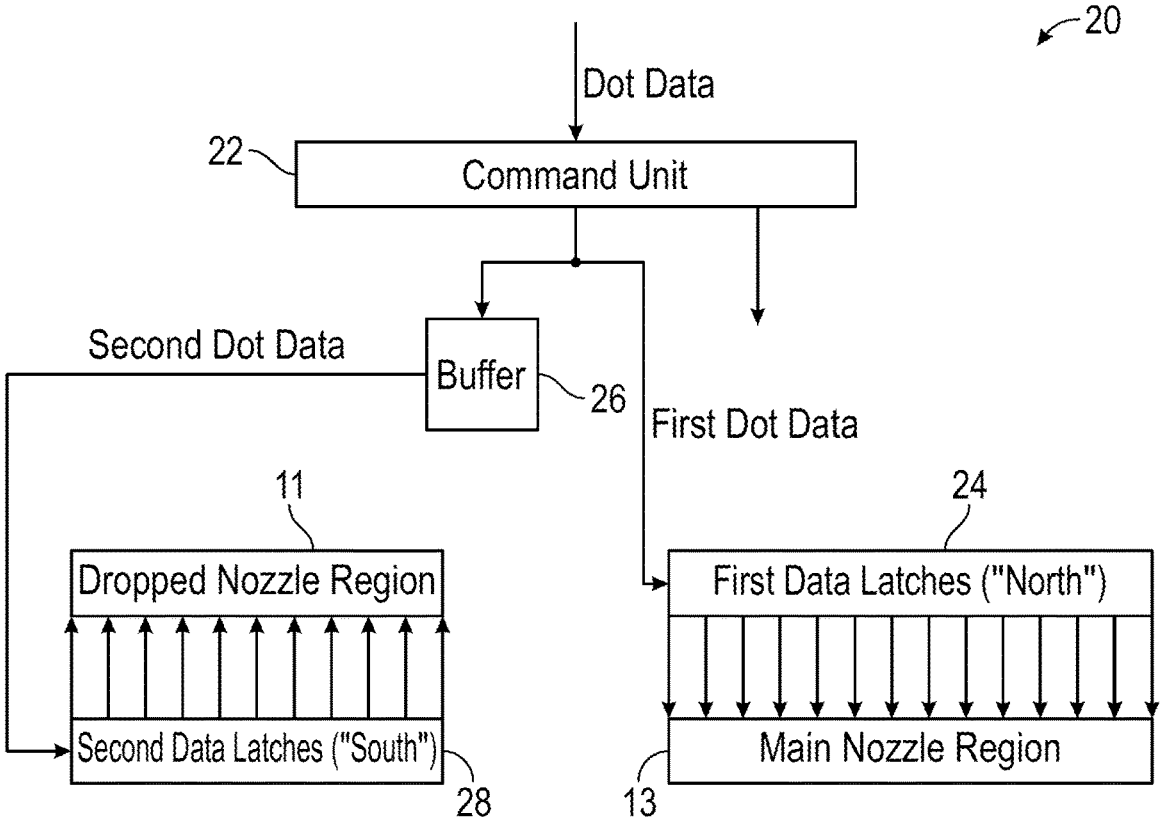
FIG. 5 shows logical distribution of dot data in the print chip.
Figure 6:
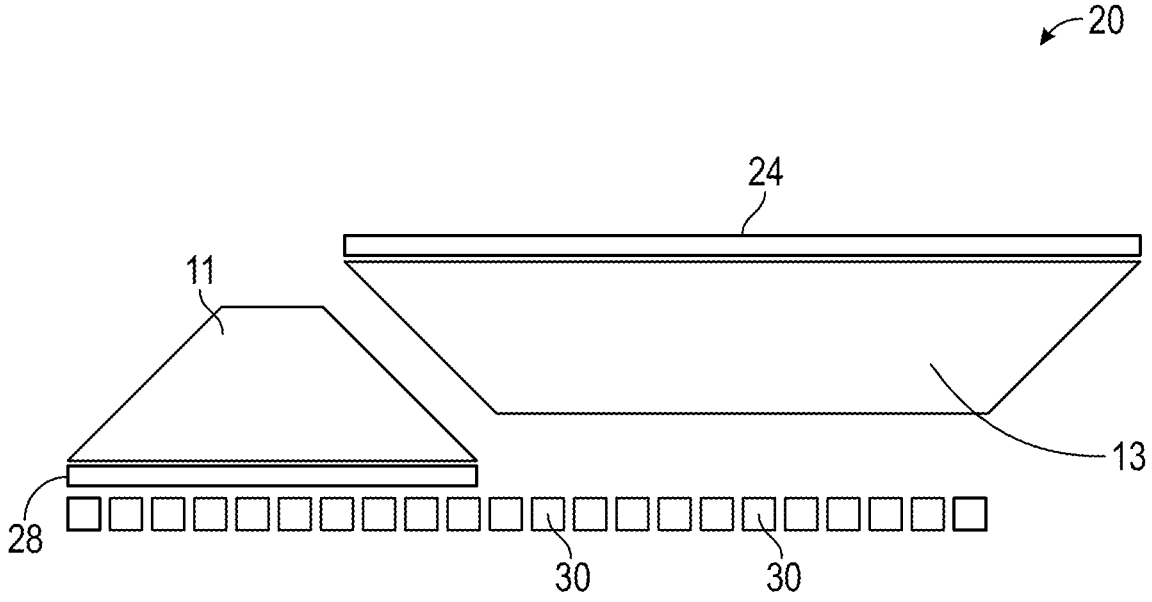
FIG. 6 shows a physical layout of selected features of the print chip.

Referring to the FIGS. 5 and 6, the print chip 20 according to one embodiment of the present invention is designed to receive dot data and fire signals on a row-by-row basis for each of 10 nozzle rows—that is, each data pulse for each nozzle row contains dot data for the main nozzle region and the dropped nozzle region, such that the data pulses contain an equal amount of data (e.g. 640 bits corresponding to 640 nozzles in each nozzle row). However, second dot data associated with the dropped nozzle region 11 is routed separately from first dot data associated with the main nozzle region 13 by a command unit 22 of the chip. Whereas the command unit 22 sends first dot data associated with the main nozzle region 13 directly to corresponding first data latches 24, second dot data associated with the dropped nozzle region 11 is routed to a dedicated buffer 26. The buffer 26 has a data capacity corresponding to the number of nozzles in the dropped nozzle region 11.

The second dot data stored in the buffer 26 is transferred to second data latches 28 corresponding to the dropped nozzle region 11 only after a predetermined delay retrieved from a dedicated delay register of the command unit 22. The value of the predetermined delay stored in the delay register is configurable based on the print job, and may be set by an upstream print controller (not shown) at the start of each print job based on the print speed and print resolution. In this way, dot data for the same line of print can be transferred to the print chip 20 simultaneously in one data pulse, whilst firing of droplets in the dropped nozzle region 11 is delayed relative to the those in the main nozzle region 13. Since the delay is determined by the print speed and print resolution, unlike the print chip 1 described in U.S. Pat. No. 7,290,852, nozzle rows 3 in the dropped nozzle region 11 may be fired at different times to nozzle rows in the main nozzle region 13, and not necessarily at the same time as any other nozzle row in the main nozzle region.

The order in which nozzles rows 3 are fired is determined based on optimal dot placement and minimum error for a given print resolution and print speed. The row firing order is determined by the print controller communicating with the print chip 20.

Referring to FIG. 6, the print chip 20 has a physical layout and architecture configured for efficient use of available space on the chip. The first and second data latches 24 and 28 corresponding to the main nozzle region 13 and dropped nozzle region 11 are positioned at opposites sides of their respective nozzle arrays. Data and power are received via a row of bond pads 30 positioned along one longitudinal side of the print chip 20 opposite the first data latches 24.

The second data latches 28, which receive second dot data via the buffer 26, are positioned along a trailing row of the dropped nozzle region 11—that is, a longer side of the trapezoidal dropped nozzle region. The first data latches 24, which receive first dot data directly from the command unit 22, are positioned along a leading row of the main nozzle region 13. By positioning the second data latches 28 opposite the first data latches 24, conductive traces can extending from the second data latches across the print chip 20 towards the nozzle devices without fanning outwards from single point. This arrangement therefore avoids a high concentration of current in one region of the chip.

Figure 7A:
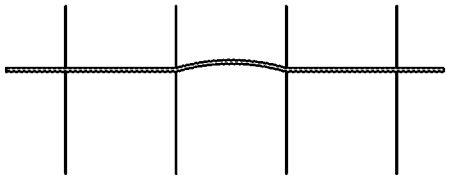
FIGS. 7A and 7B are simulated test prints using printing methods described herein.
Figure 7B:
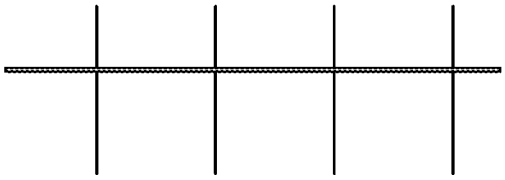

FIGS. 7A and 7B are simulated test prints showing the effect of independent firing of the dropped nozzle region when printing at 400 dpi at a nominal 5× print speed. In FIG. 7A, using the method described in U.S. Pat. No. 7,290,852, the join region between two neighboring print chips is visible as a hump due to imperfect dot placement in the dropped nozzle region. However, as shown in FIG. 7B, with independent firing of the dropped nozzle region, the join region is not visible in the same print mode.

Sub-Row Firing

Ideally, all nozzles contained in the main row portion of a given nozzle row should be fired simultaneously; and the same is also true of nozzles in the dropped row portion. Simultaneous firing of nozzles would ensure that all droplets corresponding to the same image line land on the passing media simultaneously. However, in practice, and as explained in U.S. Pat. No. 7,780,256, it is impossible to fire all enabled nozzles simultaneously, because print chips have inherent power constraints.

For this reason, nozzles are logically grouped into contiguous span groups, with the number of nozzles in each span group defining a 'span'. Only one nozzle from each span group can be fired simultaneously and once these nozzles have fired then a subsequent nozzle is selected from each span group for firing. For example, with span of 20, a print chip having 640 nozzles in each nozzle row contains 32 contiguous span groups (each containing 20 nozzles) and every $20^{th}$ nozzle can fire simultaneously. Thus, in this example, each nozzle row has 20 firing cycles within its allotted row-time.

The distance of the subsequently fired nozzle from the previously fired nozzle in the same span group is defined as a 'shift'. Thus, a shift 1 means a neighboring nozzle in each span group is fired. U.S. Pat. No. 7,780,256 describes some criteria for setting the span and shift for optimal ink refilling as well as minimizing fluidic crosstalk aerodynamic interference between ejected droplets.

From the foregoing, it will be apparent that the effects of span and shift inevitably produce print artefacts, because the print media is constantly moving during single-pass printing. With a shift of 1, for example, each line of print is actually printed as a sawtooth. When printing at normal speeds, the effects of span and shift are barely noticeable because, although the media is continuously moving, it is effectively stationary on the timescale of each row-firing cycle. However, when printing at very high speeds, print artefacts arising from span and shift become more noticeable due to the increased movement of the media within one row-firing cycle. For example, when printing at 10× print speed using two aligned monochrome printheads, the media will move by 2 DP within one row-firing cycle. Thus, the 'height' of each sawtooth will be 2 DP, which may be unacceptable for some print applications.

In a sub-row firing scheme, nozzles from each of the ink planes share printing of droplets for each image line. Thus, with five ink planes (corresponding to ten even/odd nozzle rows) in a monochrome Memjet® print chip, Rows 0, 2, 4, 6 and 8 can each fire 20% of even droplets, while Rows 1, 3, 5, 7 and 9 can each fire 20% of odd droplets for a given image line. By contrast with conventional row-wise firing, in which all enabled nozzles in the same nozzle row are fired within one row-time, in the sub-row firing scheme, all aligned nozzle rows (e.g. all even nozzle rows or all odd nozzle rows) of the print chip fire their enabled nozzles, based on latched dot data, within one row-time. A row-time is less than or equal to a time period allocated for firing all nozzles in the print chip divided by the number of nozzle rows.

Advantageously, sub-row firing facilitates mapping of data for a given line of print to whichever nozzle row is best placed for horizontal alignment of a printed line of dots. So instead of an error of 2 DP over one row-firing cycle in the example above, the error can be reduced to less than 1 DP with suitable mapping of dot data over the 5 usable nozzle rows in each row-firing cycle. Effectively, sub-row firing enables the height of the sawtooth artefact described above to be reduced by a factor of 5.

In order to enable sub-row firing, the number of nozzles N in each span must be an integer multiple of the number of ink planes M. For example, with five ink planes in a Memjet print chip, the span should be 5, 10, 15, 20 etc. Consequently, a predetermined number of nozzles P in each individual span that are used for firing is N divided by M.

In one preferred sub-row firing scheme, the span is 5 and the shift is 1, with different ink planes sequentially printing from shifted nozzles along each span (e.g. Row 0 prints with $0^{th}$ nozzle from each span within first 20% of one row-time, Row 2 prints with $1^{st}$ nozzle from each span with second 20% of one row-time, Row 4 prints with $2^{nd}$ nozzle from each span within third 20% of one row-time, Row 6 prints with $3^{rd}$ nozzle from each span with fourth 20% of one row-time, and Row 8 prints with $4^{th}$ nozzle from each span within final 20% of one row-time). Advantageously, sub-row firing when combined with appropriate mapping of line data to each nozzle row reduces the effects of span and shift artefacts at very high print speeds. A further advantage is that a shift value of 1 will not generate any problems associated with fluidic crosstalk or ink refilling, since shifted nozzles are not in the same nozzle row.

It will, of course, be appreciated that the present invention has been described by way of example only and that modifications of detail may be made within the scope of the invention, which is defined in the accompanying claims.

The invention claimed is:

1. A method of printing an image from a printhead module having a plurality of horizontal ink planes M supplied with a same ink, each ink plane having at least one nozzle row, the nozzles rows of all ink planes having vertically aligned nozzles, the method comprising the steps of:

defining contiguous span groups along each nozzle row, each span group containing N nozzles;

allocating dot data for each image line of the image to a predetermined number of nozzles P in each span group of each nozzle row;

sending the dot data to the printhead module and firing nozzles, based on the dot data, sequentially from each of the M ink planes to print the image line of the image such that all ink planes contribute dots to the printed image line, wherein:

only one nozzle from each span group in a same nozzle row is fired simultaneously;

N is an integer multiple of M; and

P is N divided by M.

2. The method of claim 1, wherein each ink plane comprises a pair of nozzle rows.

3. The method of claim 2, wherein the pair of nozzle rows are offset for printing even and odd dots.

4. The method of claim 1, wherein said method is repeated for printing all image lines of the image.

5. The method of claim 1, wherein span groups of different nozzle rows having different firing nozzles.

6. The method of claim 5, wherein the firing nozzles in the span groups of consecutively fired nozzle rows are horizontally shifted by S nozzles.

7. The method of claim 6, wherein S is 1.

8. The method of claim 1, wherein $1/M^{th}$ of the image line is printable by each ink plane.

9. The method of claim 1, wherein the dot data comprises a '1' for an enabled firing nozzle and a '0' for a non-enabled non-firing nozzle.

10. The method of claim 1, wherein all aligned nozzle rows in the M ink planes are fired, based on the dot data, within one row-time, and wherein one row-time is less than or equal to a time period for firing all nozzles in the printhead module divided by the number of nozzle rows.

11. The method of claim 1, wherein one or more steps of said method are repeated to print all image lines of the image.

12. The method of claim 1, wherein the dot data is allocated to a given nozzle row based on a print speed and a position of print media during the sequential firing of nozzles from each of the M ink planes.

13. The method of claim 1, wherein corresponding span groups in different nozzle rows are vertically aligned.

* * * * *